United States Patent [19]

Engel

[11] 4,027,227

[45] May 31, 1977

[54] COMBINATION VOLTAGE REGULATING SYSTEM

[75] Inventor: Christopher M. Engel, Franklin Park, Ill.

[73] Assignee: Zenith Radio Corporation, Glenview, Ill.

[22] Filed: Jan. 4, 1974

[21] Appl. No.: 430,801

[52] U.S. Cl. ..... 323/8; 323/22 T; 323/23

[51] Int. Cl.[2] ..... G05F 1/48

[58] Field of Search ..... 323/8, 17, 22 T, 22 Z, 323/23, 25

[56] References Cited

UNITED STATES PATENTS

| | | | |
|---|---|---|---|
| 3,124,698 | 3/1964 | Semmer et al. | 323/22 T |
| 3,419,789 | 12/1968 | Gately | 323/22 T |
| 3,652,922 | 3/1972 | Healey et al. | 323/22 T |

*Primary Examiner*—A. D. Pellinen
*Attorney, Agent, or Firm*—Nicholas A. Camasto

[57] ABSTRACT

A regulation system includes a series regulator comprising a Darlington arrangement of transistors, a Zener diode shunt regulator, and a current sensor for controlling the series regulator in accordance with the Zener current. The regulation system is on an integrated circuit with the exception of the voltage dropping resistors.

10 Claims, 8 Drawing Figures

COMBINATION VOLTAGE REGULATING SYSTEM

BACKGROUND OF THE INVENTION

This invention relates generally to voltage regulating systems and specifically to voltage regulating systems for integrated circuits where the maximum power the circuit must dissipate is of prime importance.

Regulators may be broadly characterized into series and shunt types. Generally, a series regulator is, as its name implies, connected in series between a source of unregulated voltage and a load and function to maintain a constant voltage at the load. Ideally, the impedance presented by the series regulator, at its maximum regulation point (saturation) is zero and, consequently, its internal power dissipation is minimum at this point. The series regulator may include a shunting resistance through which portions of the load current pass depending upon the state of the regulator.

A shunt regulator regulates by diverting current from the load in the event of increased supply voltages. The power consumed by a shunt regulator is negligible below the potential at which it regulates and increases in a linear manner with increases in supply voltage. The shunt regulator also includes a resistance connecting it to the source of unregulated potential and the load is connected to the junction point. This resistor and the shunting resistor in the series regulator dissipate power, which while always undesirable, is especially so in integrated circuit applications.

It would thus be very desirable to arrange a regulator such that its maximum internal power dissipation, over the regulating range, is minimized and such that only the regulator components themselves (as distinct from the voltage dropping resistors) are actually in the integrated circuit. The latter condition involves the important economic consideration of maintaining a reasonable number of pin connections between the integrated circuit (IC) and external circuitry, which, as is well-known, constitutes a major cost of an IC.

Accordingly, a principal object of this invention is to provide a novel regulating system.

Another object of this invention is to provide a regulating system having minimum regulator power dissipation for a given set of regulating criteria.

SUMMARY OF THE INVENTION

In accordance with the broad aspects of the invention, a regulating system has a peak regulator power dissipation which is less than that of either a series regulator or a shunt regulator regulating over the same range. The regulator power dissipation curve is characterized by at least two minima and two maxima. More specifically, the invention comprises a combination series and shunt regulator with a sensor for controlling the series regulator to maintain current flow in the shunt regulator over a portion of the regulating range.

PRIOR ART

Prior art U.S. Pat. No. 3,428,885 discloses a Zener diode shunt regulator circuit and means compensating for slight fluctuations in diode voltage resulting from load changes. The diode current flows in the emitter-base circuit of a transistor which supplies a control potential to another transistor connected in parallel with the Zener diode.

BRIEF DESCRIPTION OF THE DRAWINGS

The features of the invention which are believed to be novel are set forth in the appended claims. The invention, together with further objects and advantages thereof may best be understood by reference to the following description taken in conjunction with the accompanying drawings in which:

FIG. 2 represents a simple series regulator with a shunt resistance;

FIG. 3 is a graph showing the calculated power dissipation of the FIG. 2 regulator to be parabolic in shape;

FIG. 4 is the actual power dissipation curve of the FIG. 2 regulator with maximum and minimum points identified;

FIG. 5 represents a simple shunt regulator;

FIG. 6 is the graph of the power dissipation of the FIG. 5 regulator;

FIG. 7 is a simplified combination regulator of the invention; and

FIG. 8 is the power dissipation curve of the FIG. 7 combination regulator showing the maxima and minima points. The attractiveness of the combination regulator of the invention will be readily apparent in an integrated circuit environment where maximum power dissipation of components is of critical importance. One specific environment for the regulator is that of a color television receiver and in particular, in an integrated circuit including automatic contrast control circuitry. However, it will be obvious that the invention is equally applicable in a broad area of environments and that the restriction of a color television receiver or any specific circuitry thereon should not be inferred.

PREFERRED EMBODIMENT OF THE INVENTION

Figure 1:
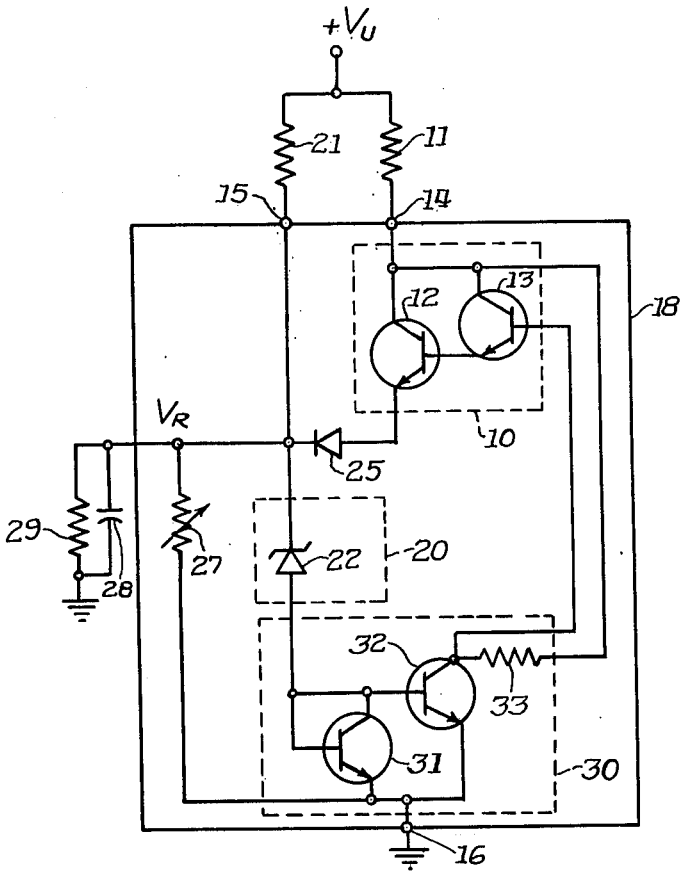
FIG. 1 is a schematic diagram of the combination regulator of the invention.

In FIG. 1, $+V_U$ represents a source of unregulated voltage supplying a regulated voltage $V_R$ to a load resistor 27, indicated as being variable. The solid line box delineates an area included within an integrated circuit 18. The points of connection between circuit components on the integrated circuit chip and components outside the chip are indicated by terminals 14, 15 and 16. In actual practice, the IC would contain many more circuits and elements, it being understood that only those of interest to the regulator are illustrated for clarity. The source of voltage is connected to terminals 14 and 15 through a pair of voltage dropping resistors 11 and 21, respectively, about which more will be said later. Connector 16 is connected to an outside ground. While in a specific case, the load may be entirely located on the integrated circuit chip, it may be desirable to also supply an external load, albeit the external load may be another integrated circuit. This is generally indicated by a load resistor 29, outside of IC 18, and in parallel with load resistor 27. Note that load resistor 29, while shown adjacent load resistor 27 for clarity, is connected to connector 15 and thus no additional IC pins are required to supply it. A bypass capacitor 28, located off the chip, is coupled in parallel with the load resistors.

The components on the chip are generally grouped as indicated by the three dashed-line boxes 10, 20 and 30. Dashed line box 10 encloses a series regulator, dashed line box 20, a shunt regulator and dashed line box 30, a current sensor for interrelating the series and shunt regulators. Elements in the circuit have been arranged to accent the correspondence between blocks 10, 20 and 30 and equivalent elements in the simplified schematics used in the derivation of mathematical relationships.

Series regulator 10 comprises a Darlington connection of a pair of transistors 12 and 13 which provides a relatively high input impedance and correspondingly, a higher loop gain. The collectors of the transistors are tied together to connection pin 14. The emitter of transistor 12 is connected, through a short circuit protection diode 25, to connection pin 15 and the emitter of transistor 13 is connected to the base of transistor 12, thus completing the Darlington connection.

The shunt regulator comprises a Zener diode 22 having its cathode terminal connected to connection pin 15 and its anode terminal connected to current sensor 30. Sensor 30 comprises a pair of transistors 31 and 32 with the collector and base of transistor 31 and the base of transistor 32 tied together at the anode of Zener diode 22. The transistor emitters are both connected to ground connection pin 16. This arrangement will be recognized by those skilled in the art as a "current mirror" presenting a very low impedance to ground for Zeneer diode 22. Since the collector to base voltage of transistor 31 is zero, it is not in saturation and nearly all of the current flowing through Zener diode 22 flows in its collector junction. In practice, transistors 31 and 32 are monolithic with the junction area of transistor 32 being about 10 times the junction area of transistor 31. Consequently, a ten-to-one current gain is obtained in current sensor 30. The collector of transistor 32 is energized from $+V_U$ through voltage dropping resistor 11 and load resistor 33, and in turn supplies control potential to the base of transistor 13 in series regulator 10.

While in a usual operating environment, the load varies (indicated by the showing of load 27 as a variable resistor), for descriptive purposes it is simpler to consider the load fixed with the source of unregulated voltage being variable. As will become apparent during the derivation of the equations for the regulator relationships, under minimum voltage conditions, that is, the maximum decrease in supply voltage for which the regulator can compensate, the series regulator is in saturation, thus dissipating very little power and the Zener diode is at a current threshold below which it will turn off or cease conduction. Consequently, it too is dissipating very little power. As the unregulated voltage increases, the series regulator is progressively driven to cutoff by the current sensor. Continued increases in supply voltage cut off the series regulator and the Zener diode becomes the sole means of regulation by conducting excess current away from the load. Its power dissipation, therefore, rises linearly over this range.

In more detail, it will be seen that the bias on the Darlington pair of transistors in series regulator 10 is controlled by resistor 11, resistor 33 and the collector-to-emitter impedance of transistor 32 of current sensor 30. Increases in current in the Zener diode result in an increase in collector-emitter current in transistor 32 and diminished forward bias on transistor 13, thus cutting off the series regulator to maintain the Zener diode current constant. This action continues until the current sensor succeeds in cutting off the series regulator and opens the current path to the load through resistor 11. At this point the series regulator is again dissipating substantially zero power. Thereafter, further increases in unregulated voltage result in increased voltage drops across resistor 21 which force more current into Zener diode 22. As the Zener diode accept the additional current, its power dissipation goes up linearly.

As will be seen, the power dissipation curve for a series regulator, shunted by a resistor, is a parabola with points of minimum dissipation occurring at the beginning and end of the series regulator operating range, with an intermediate point of maximum power dissipation, whereas the power dissipation curve for a shunt regulator is a straight line. In the preferred mode of operation, the maximum dissipation point of the series regulator is selected to equal the maximum design dissipation point of the shunt regulator, thus minimizing the peak power dissipation needs of the integrated circuit chip, which is the criterion of greatest interest.

As mentioned, diode 25 is provided for accidental short circuit protection and plays no part in the voltage regulating function of the circuit. In the event of a short at pin 14 for example, transistor 12 is protected from an emitter junction breakdown which could destroy it.

Reference is now made to FIGS. 2–8 of the drawings which should be referred to in connection with the following mathematical derivations of the design equations for the combination regulator of the invention. For completeness, the equations for idealized series (with shunt resistor) and shunt regulators will be derived first.

DERIVATIONS $P_{DISS}$ is the power dissipation in a series regulator.
$P_{DISS}$ is the power dissipation in a shunt regulator.
$V_U$ is the unregulated voltage.
$\Delta V$ is the change in unregulated voltage.
$V_R$ is the regulated voltage.
$I_L$ is the load current.

SERIES REGULATOR WITH A SHUNTING RESISTOR (FIG. 2)

ASSUMPTIONS $P_{DISS_S} = 0$ at $V_U = V_{U_{min}}$ (Sat.)
$P_{DISS_S} = 0$ at $V_U = V_{U_{max}}$ (Cutoff)
Where $V_{U_{min}}$ and $V_{U_{max}}$ represent the extreme design voltage range of the unregulated supply.
$V_R \approx$ Constant
$I_L \approx$ Constant

— 0 —

When $V_U = V_{U_{min}}$ $$I_{1_{MIN}} = \frac{V_{U_{MIN}} - V_R}{R_1} \quad (1)$$

$$\left. I_{2_{MAX}} = \frac{V_{U_{MIN}} - V_R}{R_2} \right\} \text{Series Reg. is Saturated} \quad (2)$$

$$I_1 + I_2 = I_L \quad (3)$$

$$I_{1_{MIN}} + I_{2_{MAX}} = I_L \quad (4)$$

As $V_U$ increases, $$V_U = V_{U_{MIN}} + \Delta V$$

$$I_1 = I_{1_{MIN}} = \frac{\Delta V}{R_1} \quad (5)$$

$$I_2 = \frac{V_{U_{MIN}} + \Delta V - V_S - V_R}{R_2}$$

Since $I_{2_{MAX}} = \dfrac{V_{U_{MIN}} - V_R}{R_2}$ $$I_2 = I_{2_{MAX}} + \frac{\Delta V - V_S}{R_2} \quad (6)$$

Using (5) and (6) in (3)

$$I_{1_{MIN}} + \frac{\Delta V}{R_1} + I_{2_{MAX}} + \frac{\Delta V - V_S}{R_2} = I_L \quad (7)$$

Using (4) in (7) and cancelling $$\frac{\Delta V}{R_1} + \frac{\Delta V - V_S}{R_2} = O \quad (8)$$

Solving (8) for $V_S$ $$\left[\frac{R_2}{R_1} + 1\right]\Delta V = V_S \quad (9)$$

Using (9) in (6):

$$I_2 = I_{2_{MAX}} + \frac{\Delta V - \left[\frac{R_2}{R_1} + 1\right]\Delta V}{R_2}, \text{ and}$$

$$= I_{2_{MAX}} - \frac{\Delta V}{R_1} \quad (10)$$

From (9) and (10)

$$P_{DISS_S} = I_2 V_S$$

$$= \left[I_{2_{MAX}} - \frac{\Delta V}{R_1}\right]\left[\frac{R_2}{R_1} + 1\right]\Delta V \quad (11)$$

For simplicity let $$\frac{R_2}{R_1} + 1 = k \text{ (a design constant)} \quad (12)$$

$$P_{DISS_S} = \left[I_{2_{MAX}} - \frac{\Delta V}{R_1}\right] k\,\Delta V$$

$$P_{DISS_S} = \frac{-k}{R_1}(\Delta V)^2 + k\, I_{2_{MAX}}\,\Delta V \quad (13)$$

The above can be shown to be the equation of a parabola by completing the square.

$$\left[\sqrt{\frac{k}{R_1}}\,\Delta V - \frac{\sqrt{kR_1}\, I_{2_{MAX}}}{2}\right]^2 = -P_{DISS_S} + \frac{kR_1}{4} I_{2_{MAX}}^2$$

$$\text{Let } x' = \sqrt{\frac{K}{R_1}}\,\Delta v - \frac{\sqrt{kR_1}\, I_{2_{MAX}}}{2}$$

-continued $$y' = -P_{DISS_S} + \frac{kR_1}{4} I_{2_{MAX}}^2$$

$$x'^2 = y' \quad (14)$$

Figure 3:
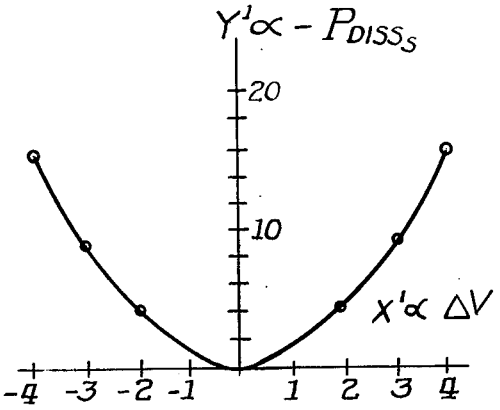

(14) is the equation of the parabola shown in FIG. 3. The peak dissipation occurs when $$\frac{\delta P_{DISS}}{\delta \Delta V} = \frac{-k}{R_1} 2\Delta V + k\, I_{2_{MAX}} = O$$

$$\Delta V \Big|_{MAX\ P} = \frac{I_{2_{MAX}} R_1}{2} \quad (15)$$

Conditions for zero dissipation $$P_{DISS_S} = \frac{-k}{R_1}(\Delta V)^2 + k\, I_{2_{MAX}} \Delta V = O$$

First solution $$\Delta V = O$$

Second solution $$\frac{-k}{R_1}\Delta V + k\, I_{2_{MAX}} = O$$

$$\Delta V = I_{2_{MAX}} R_1 \quad (16)$$

Evaluation at Max Diss. ( (15) into (13) )

$$P_{DISS_{SMAX}} = \frac{-k}{R_1}\left(\frac{I_{2_{MAX}} R_1}{2}\right)^2 + k\, I_{2_{MAX}}\left(\frac{I_{2_{MAX}} R_1}{2}\right)$$

$$P_{DISS_{SMAX}} = \frac{I_{2_{MAX}} R_1}{2}\left[k\, I_{2_{MAX}} - \frac{k}{R_1}\,\frac{I_{2_{MAX}} R_1}{2}\right]$$

$$= \frac{I_{2_{MAX}} R_1}{2}\left[\frac{k\, I_{2_{MAX}}}{2}\right]$$

$$P_{DISS_{SMAX}} = \frac{k}{4} I_{2_{MAX}}^2 R_1 \quad (17)$$

Figure 4:
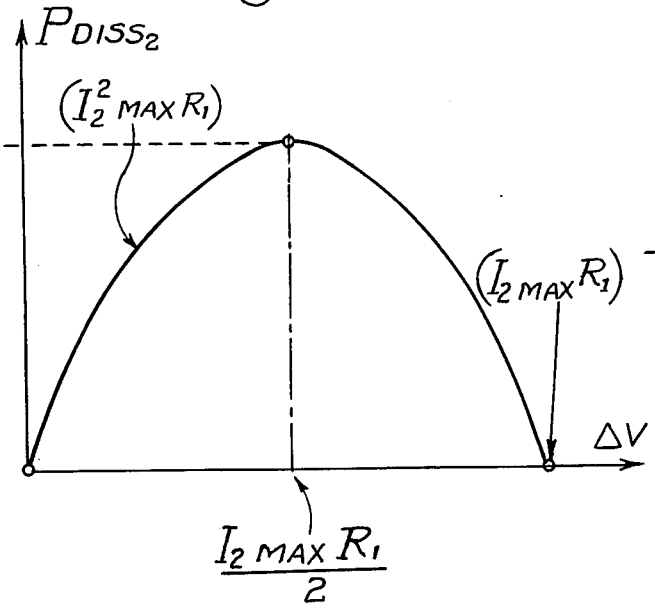
Figure 5:
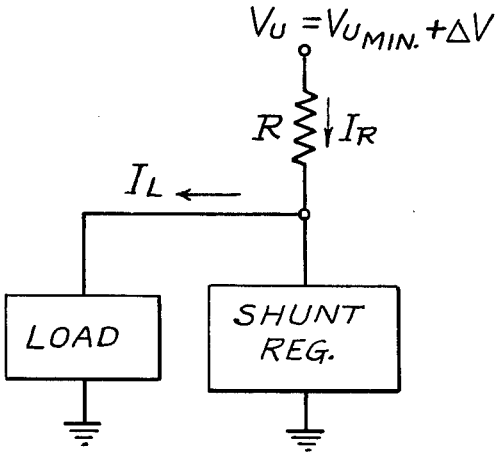
Figure 7:
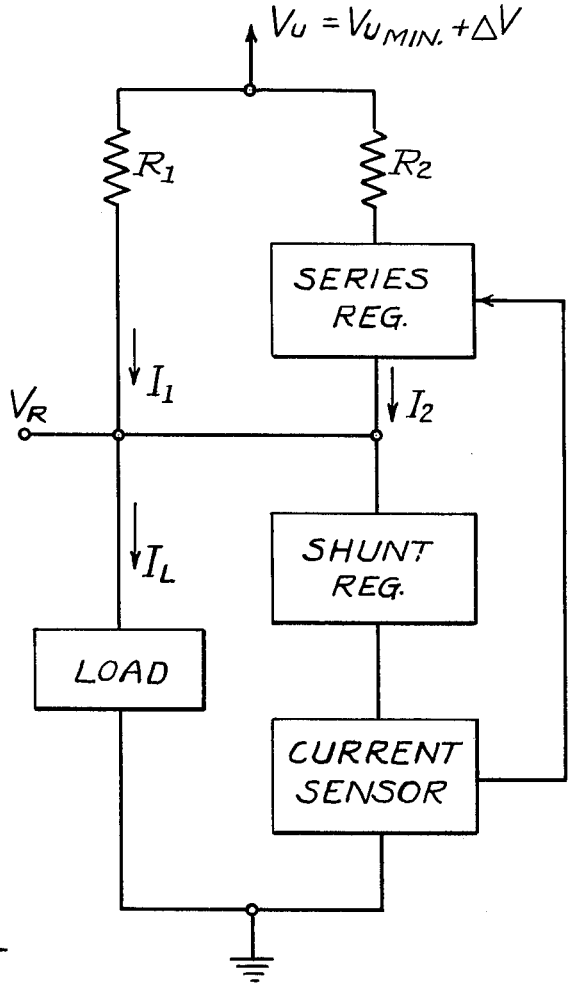

We have shown (FIG. 3) that the power dissipation characteristic is a parabola which opens in the direction of $-P_{DISS_S}$ (see FIG. 4). It crosses zero at $\Delta V=0$ and $\Delta V=I_{2_{max}}R_1$. The peak occurs at $$\Delta V = \frac{I_{2_{MAX}} R_1}{2}.$$

SHUNT REGULATOR

(FIG. 5)

$V_{U_{min}}$ corresponds to the threshold of conduction for the Zener.

$$V_U = V_{U_{MIN}} + \Delta V$$

$\Delta I = \dfrac{\Delta V}{R}$, $\Delta I$ flows through the Zener $$P_{DISS_Z} = \Delta I \times V_R$$

$$= \frac{\Delta V}{R} \times V_R$$

When $V_U = V_{U_{MIN}}$ $(\Delta V = O)$, $I_R \simeq I_L$ $$P_{DISS_Z} \simeq O \quad (18)$$

Figure 6:
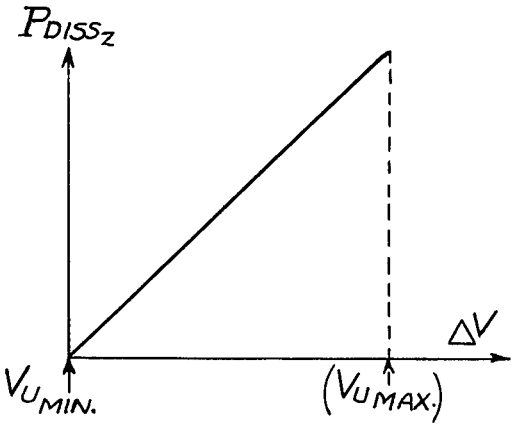

The dissipation characteristic is shown in FIG. 6, and is seen to be linear.

COMBINATION REGULATOR

(FIG. 7)

Figure 8:
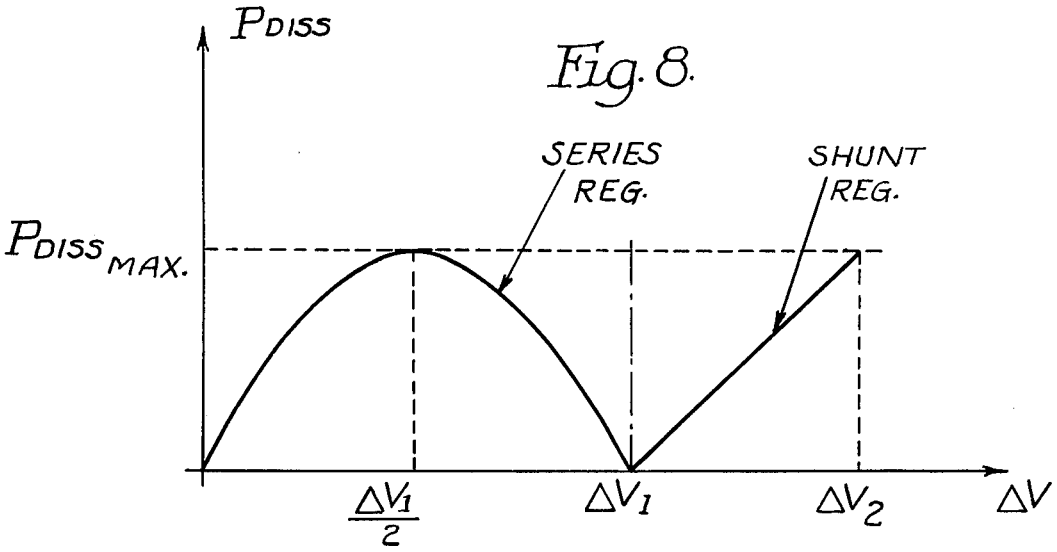

The dissipation curve should be a combination of the curves for the series and shunt cases as shown in FIG. 8, where the regulation range is $0<\Delta V<\Delta V_2$, and the crossover point from series to shunt regulation is at $\Delta V_1$. From previous analysis $$P_{DISS_{SMAX}} = \frac{k}{4} I_{2_{MAX}}^2 R_1$$

$$\text{Where from (12), } k = \frac{R_2}{R_1} + 1 \tag{17}$$

By inspection of FIG. 8, and from previous analysis $$P_{DISS_{ZMAX}} = V_R \frac{(\Delta V_2 - \Delta V_1)}{R_1} \tag{19}$$

Figure 2:
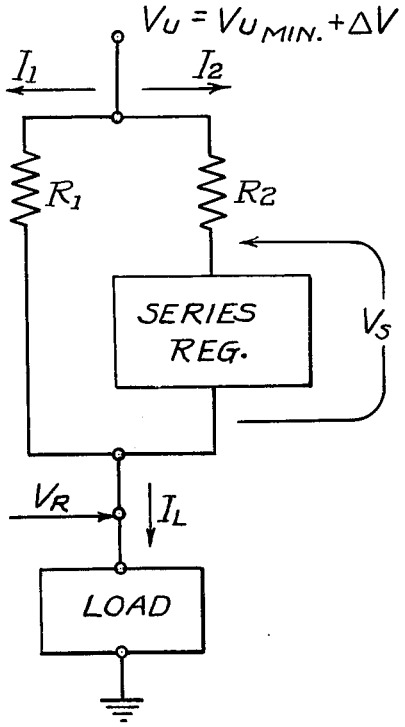
FIG. 2–8 are representative circuits and curves useful in the mathematical derivation of regulator design parameters, more specifically.

And that for the series regulator with a resistor shunt, by inspection of FIG. 2

$$I_i = I_{1_{CO}} = I_{1_{MIN}} + \frac{\Delta V_1}{R_1}, \text{ and}$$

$$\text{Where } I_{1_{CO}} \text{ is } I_1 \text{ when } \Delta V = \Delta V_1$$

$$I_L = I_1 + I_2 = I_{1_{MIN}} + I_{2_{MAX}} k \text{ and}$$

$$I_{1_{MIN}} + I_{2_{MAX}} = I_{1_{MIN}} + \frac{\Delta V_1}{R_1}, \text{ or} \tag{20}$$

$$I_{2_{MAX}} = \frac{\Delta V_1}{R_1}$$

$$\text{From (2) } \frac{V_{U_{MIN}} - V_R}{R_2} = I_{2_{MAX}}$$

$$\text{Thus } \frac{V_{U_{MIN}} - V_R}{R_2} = \frac{\Delta V_1}{R_1}$$

$$\frac{R_2}{R_1} = \frac{V_{U_{MIN}} - V_R}{\Delta V_1}, \text{ and}$$

$$k = \frac{R_2}{R_1} + 1 \text{ (from 12)} = \frac{V_{U_{MIN}} - V_R}{\Delta V_1} + 1 \tag{21}$$

Equating (17) and (19) yields:

$$V_R \frac{(\Delta V_2 - \Delta V_1)}{R_1} = \frac{k}{4} I_{2_{MAX}}^2 R_1$$

Use of (20) in the above yields:

$$\frac{V_R}{R_1}(\Delta V_2 - \Delta V_1) = \frac{k}{4} \frac{\Delta V_1^2}{R_1}$$

$$\frac{k}{4R_1} \Delta V_1^2 + \frac{V_R}{R_1} \Delta V_1 - \frac{V_R}{R_1} \Delta V_2 = O \tag{22}$$

For simplicity let $$V_{U_{min}} - V_R = v_{MIN} \tag{23}$$

Using (21) and (23) in (22)

$$\left[\frac{V_{MIN}}{\Delta V_1} + 1\right] \frac{\Delta V_1^2}{4R_1} + \frac{V_R}{R_1} \Delta V_1 - \frac{V_R}{R_1} \Delta V_2 = O$$

-continued $$\frac{\Delta V_1^2}{4R_1} + \left[\frac{v_{MIN}}{4R_1} + \frac{V_R}{R_1}\right] \Delta V_1 - \frac{V_R}{R_1} \Delta V_2 = O \tag{24}$$

Simplifying as follows $$\Delta V_1^2 + [v_{MIN} + 4V_R]\, \Delta V_1 - 4V_R \Delta V_2 = 0$$

Recalling the definition of $v_{MIN}$ $$\Delta V_1^2 + (V_{U_{min}} + 3V_R)\, \Delta V_1 - 4V_R \Delta V_2 = \tag{25}$$

Solving for the positive root:

$$\Delta V_1 = \frac{-(V_{U_{MIN}} + 3V_R) + \sqrt{(V_{U_{MIN}} + 3V_R)^2 + 16V_R \Delta V_2}}{2} \tag{26}$$

All of the variables on the right side are design parameters. Hence we have solved for $\Delta V_1$, the cutoff point of the series regulator. Hence, $$I_{1_{CO}} = \frac{V_{U_{MIN}} + \Delta V_1 - V_R}{R_1} I_L$$

$$\text{or } R_1 = \frac{V_{U_{MIN}} \Delta V_1 - V_R}{I_L} \tag{27}$$

Recall from the derivation of (21)

$$\frac{R_2}{R_1} = \frac{V_{U_{MIN}} - V_R}{\Delta V_1}$$

$$\text{Thus } R_2 = R_1 \left[\frac{V_{U_{MIN}} - V_R}{\Delta V_1}\right] \tag{28}$$

(26), (27) and (28) are, therefore, the required equations for optimum design of the combination regulator in terms of the minimum unregulated supply voltage, the desired regulator output voltage and the range of the unregulated supply voltage.

EXAMPLE

SHUNT REGULATOR

Assumed Conditions $V_{U_{min}} = 20$ volts
$I_L = 48$ ma
$\Delta V = 8$ volts
$V_R = 12$ volts $$R = \frac{V_{U_{MIN}} - V_R}{I_L}$$

$$= \frac{20 - 12}{48\ ma}$$

$$= 166.7\ \Omega$$

From (18)

$$P_{DISS_{ZMAX}} = \frac{\Delta V}{R} \times V_R$$

$$= \frac{8}{166.7} \times 12 = \underline{\underline{575.9\ mW}}$$

SERIES REGULATOR WITH SHUNT RESISTOR $$V_{U_{MIN}} - V_R = 8 \text{ volts}$$

$$\frac{V_{U_{MIN}} - V_R}{R_p} = 48\ ma$$

$R_p = 166.7\ \Omega$
($R_p = R_1$ in parallel with $R_2$)

$$\frac{V_{U_{MIN}} + \Delta V - V_R}{R_1} = 48\ ma$$

$$\frac{16 \text{ volts}}{R_1} = 48\ ma$$

$R_1 = 333.3\ \Omega$
If $R_1$ in parallel with $R_2 = 166.7\ \Omega$
and $R_1 = 333.3\ \Omega$
Then $R_2 = 333.3\ \Omega$ $$I_{2_{MAX}} = \frac{20 - 12}{333.3}$$

$$= 24\ ma$$

$$k = \frac{R_2}{R_1} + 1 = 1 + 1 = 2$$

From (17)

$$P_{DISS_{SMAX}} = \frac{k}{4} I_{2_{MAX}}^2 R_1$$

$$= \frac{1}{2} (0.024)^2 (333.3)$$

$$P_{DISS_{SMAX}} = 96\ mW$$

COMBINATION REGULATOR

From (26)

$$\Delta V_1 = 6.176 \text{ volts}$$

$$R_1 = \frac{20 + 6.176 - 12}{48ma}$$

$$R_1 = 295.3\ \Omega$$

$$R_2 = R_1 \left( \frac{V_{U_{MIN}} - V_R}{\Delta V_1} \right)$$

$$= 295.3 \left( \frac{8}{6.176} \right)$$

$$R_2 = 382.6$$

$$k = \frac{R_2}{R_1} + 1 = 2.296$$

From (16) and (17)

$$P_{DISS_{SMAX}} = \frac{k}{4} \frac{\Delta V_1^2}{R_1}$$

$$= \frac{2.296}{4} \frac{(6.176)^2}{295.3} = \underline{\underline{74.14\ mW}}$$

From (18) and FIG. 8

$$P_{DISS_{ZMAX}} = \frac{\Delta V_2 - \Delta V_1}{R_1} \times V_R$$

$$= \frac{8 - 6.176}{295.3} \times 12$$

$$= \underline{\underline{74.12\ mw}}$$

Thus the maximum dissipation which the chip must handle is 74 mW for the combination regulator, whereas it is 96 mW for the series regulator (with a shunting resistor) and 576 mW for the shunt regulator.

Thus it has been shown that the peak power dissipated by a regulation system may be minimized, in accordance with the invention, by a series-shunt combination regulator in which each individual regulator is operative over a predetermined portion of the total range, with the maximum dissipation of each regulator being the same. The analysis may be extended to an arrangement comprising two series regulators and one shunt regulator where the series regulators operate over the initial portions of the range and the shunt regulator over the last portion.

What has been described is a novel regulation system for providing regulation over a predetermined range with minimum-maximum regulator power dissipation, thus making it highly attractive in an integrated circuit environment. It will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A regulating system, especially adapted for integrated circuits, having a maximum regulator power dissipation over its regulating range which is less than that of either a shunt or series type regulator, for supplying power at a regulated voltage to a load circuit from an unregulated voltage source comprising voltage regulating means characterized by a regulator power dissipation curve, over its regulating range, having at least two minima and two maxima.

2. A regulating system as set forth in claim 1, wherein said voltage regulating means comprises a shunt-connected voltage regulator in parallel with said load circuit and a series-connected voltage regulator connected between siad unregulated source and said load circuit.

3. A regulating system as set forh in claim 2, wherein said shunt and said series connected voltage regulators selectively exert control over distinct portions of the regulating range.

4. A regulating system as set forth in claim 3, wherein the maximum dissipation in said shunt and series voltage regulators is the same.

5. A combination regulating system comprising: a source of unregulated potential; a load requiring a source of regulated potential; first regulating means coupled to said source and said load for supplying regulated power to said load over a first range of voltages from said unregulated source; second regulating means supplying current to said first regulating means over a second range of voltages from said unregulated source to extend the regulating effect of said first regulating means; and means sensing the current in said first regulating means and supplying a compensatory control potential to said second regulating means.

6. The combination regulating system as set forth in claim 5, wherein said first regulating means coprises a shunt regulator and said second regulating means comprises a series regulator.

7. The combination regulation system as set forth in claim 6, wherein said shunt regulator comprises a Zener diode.

8. In combination; a source of unregulated portential; a load circuit; a first voltage dropping resistor and a first regulating means connected between said source of voltage and said load circuit; a second voltage dropping resistor and a second regulating means, comprising a zener diode, connected across said unregulated source and defining a junction at said load circuit; and means sensing the current in said second regulating means and supplying a control potential indicative thereof for controlling said first regulating means, said sensing means comprising a low impedance current mirror connected in series with said zener diode.

9. The combination as set forth in claim 8, wherein said first regulating means comprises a Darlington connected pair of transistors having an input circuit coupled to the output of said current mirror.

10. The combination as set forth in claim 9, wherein said first and second regulating means and said current mirror are located on an integrated circuit, said first and second voltage dropping resistors being located external to said integrated circuit.

* * * * *